US006872031B2

(12) United States Patent
May

(10) Patent No.: US 6,872,031 B2
(45) **Date of Patent: *Mar. 29, 2005**

(54) APPARATUS AND METHOD OF SUPPORTING A STRUCTURE WITH A PIER

(76) Inventor: Donald May, 25662 S. Brentwood Dr., Sun Lakes, AZ (US) 85248

( * ) Notice: Subject to any disclaimer, the term of this patent is extended or adjusted under 35 U.S.C. 154(b) by 0 days.

This patent is subject to a terminal disclaimer.

(21) Appl. No.: 10/673,653

(22) Filed: Sep. 29, 2003

(65) Prior Publication Data

US 2004/0071511 A1 Apr. 15, 2004

Related U.S. Application Data

(63) Continuation-in-part of application No. 10/200,768, filed on Jul. 22, 2002, now Pat. No. 6,659,692.

(51) Int. Cl.[7] ..... E02D 11/00
(52) U.S. Cl. ..... 405/232; 405/244
(58) Field of Search ..... 405/232, 231, 405/230, 244, 252.1; 248/156, 679

(56) References Cited

U.S. PATENT DOCUMENTS

| | | | | | |
|---|---|---|---|---|---|
| 2,465,557 | A | * | 3/1949 | Thornley | 405/233 |
| 4,070,867 | A | | 1/1978 | Cassidy | |
| 4,538,938 | A | * | 9/1985 | Grzelka et al. | 405/198 |
| 4,634,319 | A | | 1/1987 | May | |
| 4,667,746 | A | | 5/1987 | Moraly | |
| 4,673,315 | A | | 6/1987 | Shaw et al. | |
| 4,678,373 | A | | 7/1987 | Langenbach, Jr. | |
| 4,733,994 | A | | 3/1988 | Simanjuntak | |
| 4,800,700 | A | | 1/1989 | May | |
| 4,854,782 | A | | 8/1989 | May | |
| 4,925,345 | A | | 5/1990 | McCown et al. | |
| 5,011,336 | A | | 4/1991 | Hamilton et al. | |
| 5,013,190 | A | | 5/1991 | Green | |
| 5,123,209 | A | | 6/1992 | Nally | |
| 5,154,539 | A | | 10/1992 | McGown et al. | |
| 5,205,673 | A | | 4/1993 | Bolin et al. | |
| 5,234,287 | A | | 8/1993 | Rippe, Jr. | |
| 5,246,311 | A | | 9/1993 | West et al. | |
| 5,253,958 | A | | 10/1993 | Bellemare | |
| 5,288,175 | A | | 2/1994 | Knight | |
| 5,310,287 | A | | 5/1994 | Arentsen | |
| 5,336,021 | A | | 8/1994 | Freeman, III | |
| 5,492,437 | A | | 2/1996 | Ortz | |
| 5,800,094 | A | * | 9/1998 | Jones | 405/230 |
| 5,980,162 | A | | 11/1999 | McCown | |
| 6,074,133 | A | * | 6/2000 | Kelsey | 405/244 |
| 6,193,442 | B1 | | 2/2001 | May | |
| 6,247,875 | B1 | * | 6/2001 | Schmednecht et al. | 405/267 |
| 6,368,022 | B1 | | 4/2002 | Zingerman | |
| 6,368,023 | B1 | | 4/2002 | Lau et al. | |
| 6,659,692 | B1 | * | 12/2003 | May | 405/232 |

* cited by examiner

*Primary Examiner*—Heather Shackelford
*Assistant Examiner*—Lisa Saldano
(74) *Attorney, Agent, or Firm*—Steptoe & Johnson LLP; Tyson York Winarski

(57) ABSTRACT

A pier assembly (20, 60) is provided that utilizes a rotatable shelf (12, 70) structure to place a screw jack assembly (15) under a footing (28) of a foundation.

16 Claims, 20 Drawing Sheets

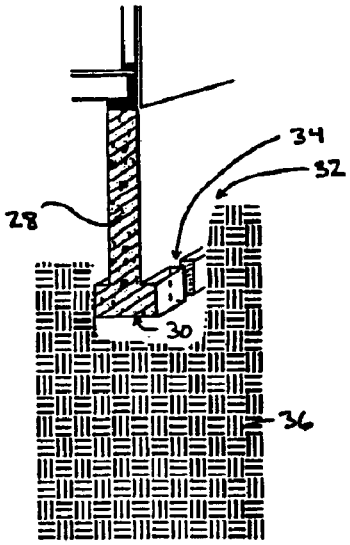
Figure 2
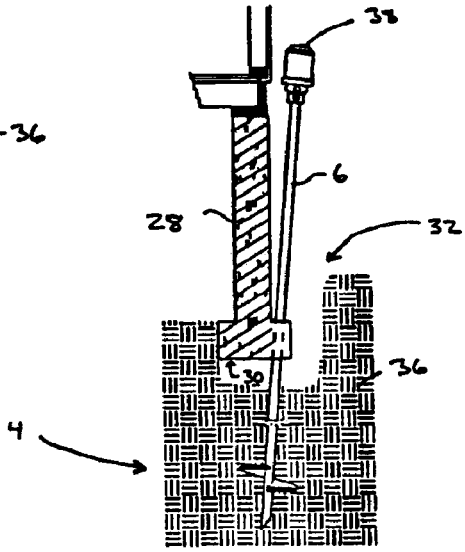
Figure 3
Figure 4
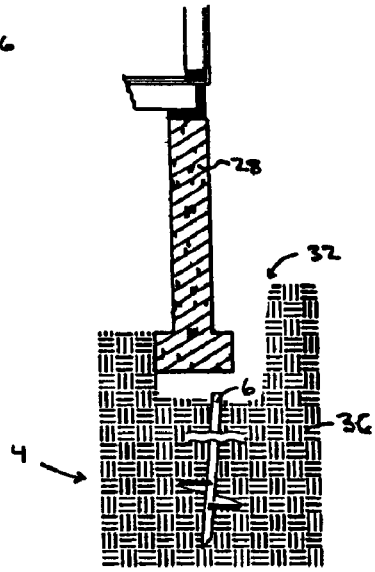

28
32
64
26
27
16
20
22
24
15
66
70
68
68
36
36
72
74
60
62
88

28
32
72
26
78
16
20
22
24
15
90
94
70
68
68
36
36
72
74
60
62
88

APPARATUS AND METHOD OF SUPPORTING A STRUCTURE WITH A PIER

This patent application is a Continuation-In-Part of application Ser. No. 10/200,768 filed on Jul. 22, 2002, now U.S. Pat. No. 6,659,692, by inventor Donald May entitled "Apparatus and Method for Supporting a Structure with a Pier and Helix."

TECHNICAL FIELD OF THE INVENTION

The present invention relates to the field of structural pier devices designed to support structural foundations and footings in order to counter the effects of settling and ground movement.

BACKGROUND OF THE INVENTION

Many structures, such as residential homes and low rise buildings, are constructed on foundations that are not in direct contact with a stable load bearing underground stratum, such as, for example, bedrock. These foundations are typically concrete slabs or a footing upon which a foundation wall rests. The footing is generally wider than the foundation wall in order to distribute the structure's weight over a greater surface area of load bearing earth. Therefore, the stability of these structures depends upon the stability of the ground underneath or supporting the foundation. With time, the stability of the underlying soil may change for many reasons, such as changes in the water table, soil compaction, ground movement, or the like. When the stability of the support ground changes, many times the foundation will move or settle. The settling of a structure's foundation can cause structural damage reducing the value of the structure or total property.

For instance, structural settling can cause cracks in foundation walls. Unsightly cracks can appear on the interior or exterior of building walls and floors. In addition, settling can shift the structure causing windows and doors to operate poorly. Inventors have recognized the foundation-settling problem and have developed various devices and methods to correct its effects.

One common device and method to correct foundation settling consists of employing hydraulic jacks in conjunction with piers to lift the foundation. Piers, also known as piles or pilings, are driven into the ground by hydraulic mechanisms until the pier reaches bedrock or until the pier's frictional resistance equals the compression weight of the structure. Once these piers are secured in a stable underground stratum or several stable underground strata, further lifting by the hydraulic jacks raises the level of the foundation. When the foundation is raised to the desired level, the piers are permanently secured to the foundation. The hydraulic jacks are then removed. This method of correcting the level of a foundation generally requires the excavation of a hole adjacent to or underneath the foundation in order to position and operate the lifting equipment.

Steel piers are well known and exist in many varieties. One common type of a pier is a straight steel pier that is driven down until it reaches bedrock or stable soil weight bearing layer. These straight steel piers are rammed straight down into the ground. Another style of pier known to the art is a helical pier. On the end of a long pier shaft is a large helix. This helix distributes the weight of the pier over a larger surface area of soil making it a highly desirable pier structure to use. Unlike straight piers that are driven straight through the earth, it is necessary to screw the helical piers into the earth through rotating the pier shaft.

The use of a screwed-in-helix with a steel shaft is very common in supporting the footings and foundations of structures. For instance, a plurality of helical piers are typically installed at structurally strategic positions along the footing or foundation of a structure. These piers are then anchored together and interconnected by setting them all within reinforced concrete. In other instances, a plurality of steel piers are installed at various angles with respect to the building. These piers are then tied together to the footing or foundation with re-enforcing bars or pin connections. These bars or pin connections are then encapsulated within concrete.

When the helical steel pier is installed to support a footing or foundation of an existing structure, the pier is installed at an angle with respect to the building in order to accommodate the mechanical equipment necessary to screw the helical pier into the earth. This angle causes the building to place a lateral force on the pier resulting in an eccentric loading. When the top of the pier extends above the bottom of the footing or foundation and the load is carried on the top of the pier shaft, the eccentricity of the load is unnecessarily extended and weakens the load bearing capacity of the pier.

A helical pier shaft is disclosed in U.S. Pat. No. 5,171,107. This patent teaches a method wherein a helical anchor is screwed down into the earth. Importantly, this patent teaches that the helical anchor extends above the footing of the building. In addition, this patent teaches that the helical anchor extends off to the side of the footing creating an eccentric loading condition. Ideally, only vertical forces will exist in the final helical pier and foundation structure. However, because the pier taught by this patent extends to the side of the footing, the foundation places a lateral force against the pier that tends to push the pier outwardly. Through this lateral force that causes an eccentric loading the building shifts laterally over the pier until the pier no longer supports the vertical weight of the building. Consequently the pier's effectiveness is neutralized and the building subsides. It is highly desirable to design a pier that reduces the degree of this eccentric loading to prevent the lateral movement of the helical pier and footing or foundation.

Further, U.S. Pat. No. 5,171,107 teaches that a bracket assembly is needed to secure the helical pier to the footing. This bracket assembly requires a costly preparation of the footing. The bottom surface of building footers is typically very rough due to the manner in constructing the footer. In order to attach the bracket for the helical pier to the bottom surface of the footer, it is necessary to prepare the footer. Otherwise, if the pier bracket is placed against the uneven surface, stress fractures will occur in the footing damaging the structure and retarding the ability of the helical pier to support the building.

Preparing the footer is a labor intensive process that requires the use of concrete chippers or saws. These mechanical devices are used by laborers to smooth the bottom surface of the footer. It is therefore highly desirable to develop a pier system that can eliminate this costly and time consuming process. In addition, the bracket assembly is a complicated piece of equipment that greatly adds to the cost of the helical pier.

There are other foundation support technologies known to the art. For instance, Ortiz, U.S. Pat. No. 5,492,437, teaches a lifting device that is made of one or more power cylinders that are pivotally linked to a pier and to a foundation bracket assembly. The pivotal linkage results in self-alignment between the longitudinal axis of the pier and the axis along which compressive pressure is applied to the pier. This patent requires the pier to be lifted above the bracket in order to position the pier within the bracket.

West et al., U.S. Pat. No. 5,246,311, discloses a pier driver having a pair of opposing first upright members straddling a pier support. The upright members are temporarily attached to the foundation and a pair of opposing first foot members operably extending beneath the foundation. A plurality of secondary lifting mechanisms, in cooperation with the piers previously installed by the pier driver, are adapted to lift the foundation. The pier supports of the pier heads are then permanently fixed to the respective piers with a bracket to provide permanent support to the foundation. This patent requires the pier to be lifted above the bracket in order to position the pier within the bracket.

Bellemare, U.S. Pat. No. 5,253,958, describes a device for driving stakes into the ground, particularly a foundation stake used for stabilizing, raising, and shoring foundations. The device disclosed has two rods secured to two hydraulic jacks, the hydraulic jacks and the rods being parallel to the driving axis of the stake. A driving member with a hammering head is provided to drive the stake into the ground. This patent requires that the pier to be lifted above the bracket in order to position the pier within the bracket.

Despite these known designs, there is a very distinct need in the art to develop an improved pier design that reduces the amount of eccentric loading on the pier to reduce the lateral movement of the footing or foundation. Still further, there is a great need in the art to develop a pier that eliminates the costly bracket assembly.

SUMMARY OF THE INVENTION

The present invention is a pier that supports a footing or foundation of a residential or commercial building. An area of earth is excavated around and beneath the footing or foundation of the structure for the pier. The pier is inserted in to the excavated area with the shaft extending through a notch formed in the foundation. Mechanical devices are then used to drive the shaft into the ground. The pier is driven to a level where there is sufficient compression in the soil to support the distributed load of the structure.

A pier-cap stabilizer is driven with force down over the pier shaft until the top of the pier meets a stop pin secured in the pier cap. A platform screw jack is placed on top of the pier cap under the footing or foundation. The jack screws are extended down onto the pier cap until the required support contact is achieved between the pier cap stabilizer and the footing or foundation.

The bottom surface of building footers is typically very rough. In order to attach a pier to the bottom surface of the footer, it is desirable to prepare the footer. The present invention prepares the footer by inserting a flexible bag filled with unhardened concrete between the top surface of the screw jack platform and the bottom surface of the footer. The unhardened concrete fills in the voids and contours on the bottom surface of the footer creating a structurally sound flat surface.

The pier-cap stabilizer includes a vertical stabilizing section that attaches to the side of the footing. With the jacks screws extended and the vertical stabilizing section attached, the installation of the helical pier is complete if the structure is at a desired height and level with respect to the ground. However, it is commonly necessary to lift the structure in height on the piers. This lifting is achieved through placing a hydraulic power ram between the top of the pier cap and under the platform screw jack. As the structure is raised by the hydraulic ram, the jack screws are turned down on to the top of the pier cap. When the screws are extended fully, the hydraulic ram is then removed and installation is complete.

BRIEF DESCRIPTION OF THE DRAWINGS

FIG. 2 depicts a preferred manner of preparing a structural footing to receive a pier shaft of a present embodiment of the invention.

FIG. 3 depicts a preferred manner of installing a helical pier in accordance to a preferred present embodiment of the invention.

FIG. 4 depicts an installed pier shaft and helix assembly in accordance to a preferred present embodiment of the invention.

FIG. 17 illustrates a side view of a straight pier having a pier cap stabilizer and screw jack assembly.

FIG. 18 illustrates an installation of a straight pier with a footing utilizing a hydraulic ram.

FIG. 19 illustrates an installation of a straight pier with a footing.

FIG. 20 illustrates an installation of a pier cap stabilizer on a straight pier.

FIG. 21 illustrates an installation of a pier cap stabilizer on a straight pier.

FIG. 22 illustrates an installation of a screw jack platform on a pier cap stabilizer and straight pier where a hydraulic ram lifts a footing with respect to the pier cap stabilizer.

FIG. 23 illustrates an installation of a screw jack platform on a pier cap stabilizer and straight pier.

FIG. 24 illustrates an additional alternative embodiment utilizing a straight pier where a pier cap stabilizer is formed from two components.

DETAILED DESCRIPTION OF A PREFERRED EMBODIMENT

Figure 1:
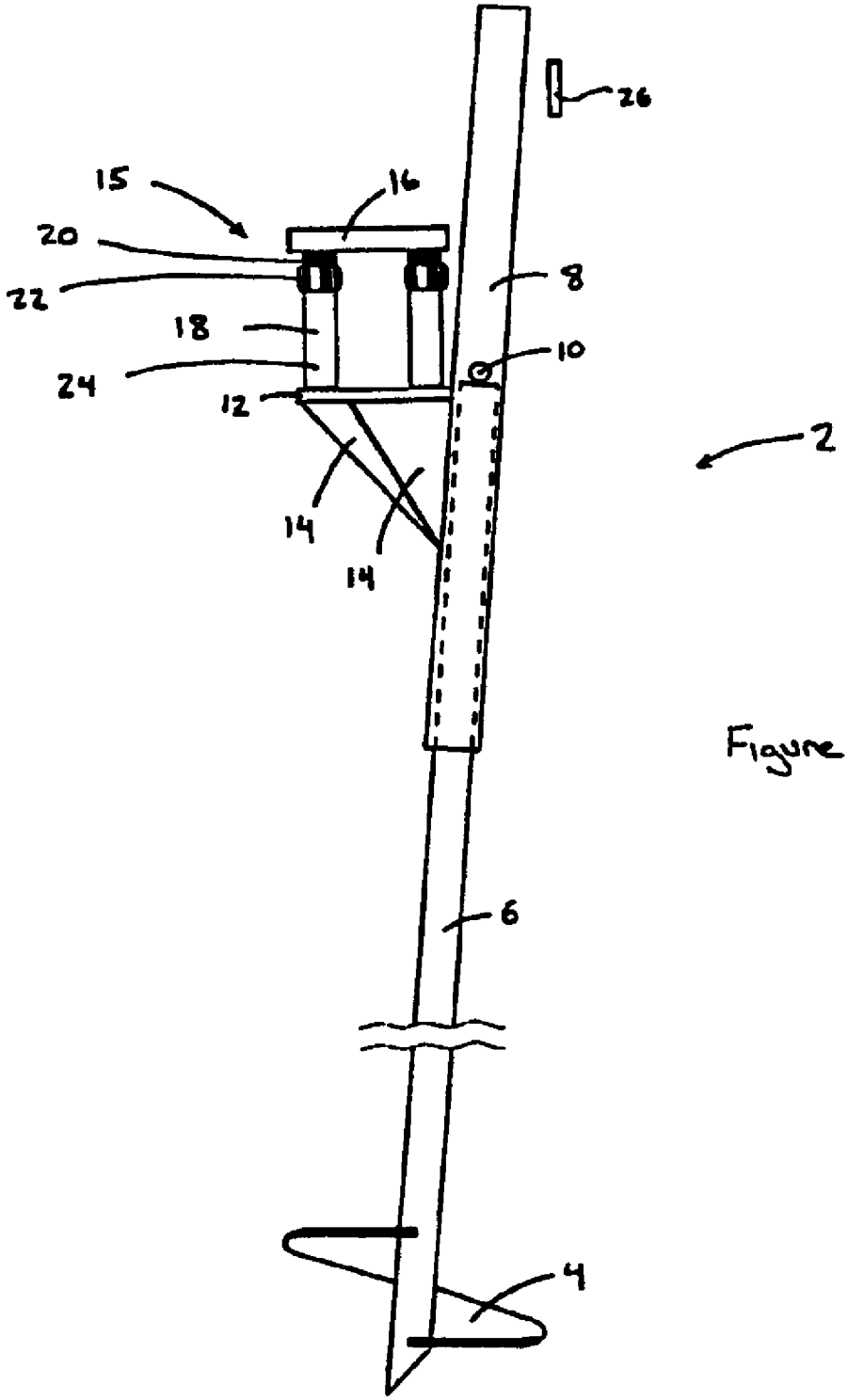
FIG. 1 depicts a preferred present embodiment of the invention.

Referring to the figures by characters of reference, FIG. 1 depicts a preferred present embodiment of the invention. The two piece helical pier assembly 2 has a helix 4 at the bottom of a pier shaft 6. Helix 4 distributes the downward pressure from a building over an area of earth. On top of the pier shaft 6 is a pier cap stabilizer 8. A bolt 10, commonly referred to as a pin, secured to pier cap stabilizer 8 prevents pier cap stabilizer 8 from sliding down along pier shaft 6.

A shelf 12 is secured to pier cap stabilizer 8 using shelf gussets 14. Shelf 12 provides support for a jack screw assembly 15. Jack screw assembly 15 is made of a jack platform 16 and two or more jack screws 18. Jack screws 18 have a threaded shaft 20, nuts 22, and jack sleeves 24. Jack screws 18 are welded to jack platform 16. Nuts 22 are welded to jack sleeves 24. Through rotating jack sleeves 24, it is possible to extend and lower jack screw assembly 15. A clamp 26 is provided to attach the top of pier cap stabilizer 8 against the side of the building.

FIG. 2 depicts a preferred manner of preparing a structural footing 28 to receive pier shaft 6 of a present embodiment of the invention. Footing 28 has a bottom surface 30. An excavated area 32 is dug around footing 28 in order to install helical pier 2. A notch 34 is formed in footer 28 in order to guide and stabilize pier shaft 6 as it is driven into earth 36. It is possible to form notch 34 in a variety of ways. One preferred method is through using a concrete saw. Alternatively, a concrete drill or a concrete chipping device could function to form notch 34. Other known ways of forming a notch in concrete can be used such as using a concrete core drill to form a hole. Note that excavated area 32 is dug around and below footer 28 to expose the bottom surface of footer 28.

FIG. 3 depicts a preferred manner of installing helical pier 2 in accordance to a preferred present embodiment of the invention. Helical pier 2 is shown positioned in notch 34. Pier shaft 6 is driven into earth 36 by torque motor 38. Through rotating helical pier 2 with motor 38, helix 4 screws its way down through earth 36 until the pier's 2 frictional resistance equals the compression weight of the structure. During this screw process, notch 34 serves to guide and stabilize pier shaft 6 during the operation. Note that during this stage in the process of installing pier 2, only helix 4 and pier shall 6 are involved. Note that in FIG. 3 it is desirable to install pier 2 at an angle in order to accommodate motor 38.

FIG. 4 depicts an installed pier shaft 6 and helix assembly 4 in accordance to a preferred present embodiment of the invention. Once helix 4 screws its way down through earth 36 until the pier's 2 frictional resistance equals the compression weight of the structure, the top of pier shall 6 is cut off below the bottom surface 30 of footer 28. At this stage, the installation of pier shaft 6 and helix assembly 4 is complete.

Figure 5:
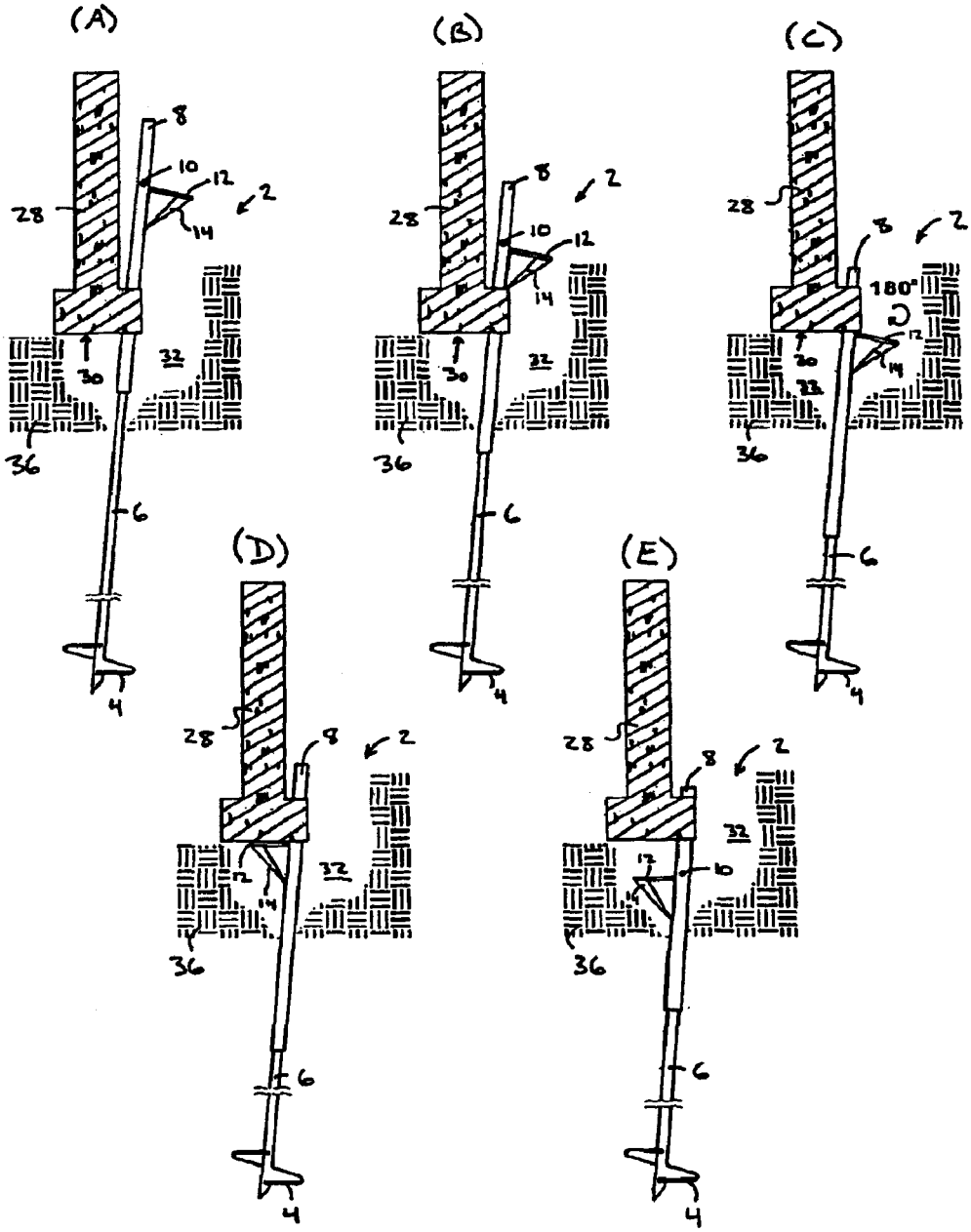
FIG. 5 depicts a preferred manner of installing a pier cap stabilizer on to a helical pier in accordance to a preferred present embodiment of the invention.

FIG. 5 depicts a preferred manner of installing a pier cap stabilizer 8 on to a helical pier 2 in accordance to a preferred present embodiment of the invention. In step (A), the pier cap stabilizer 8 is placed on top pier shaft 6. Pier cap stabilizer 8 is driven in step (B) down through earth 36 until bolt 10 comes into contact with the top of pier shaft 6. In step (C), pier cap stabilizer 8 is rotated 180 degrees until shelf 12 extends under bottom surface 30 of footer 28. Note that the shelf 12 is mounted at a slight angle with respect to pier cap stabilizer 8 in order to compensate for the slight angle that pier shaft 6 is driven into earth 6. This slight angle is provided in order to have shelf 12 parallel to bottom surface 30. Through having shelf 12 parallel to bottom surface 30, it is possible to place the load of footer 28 onto pier cap stabilizer 8.

In step (D), stabilizer pier cap 8 is shown in its final rotated position with shelf 12 extending under footer 28 in a parallel manner. Finally, pier cap stabilizer 8 is driven further into earth 36 in order to create a space between footer 28 and shelf 12 so that it is possible to insert screw jack assembly 15 onto shelf 12.

Figure 6:
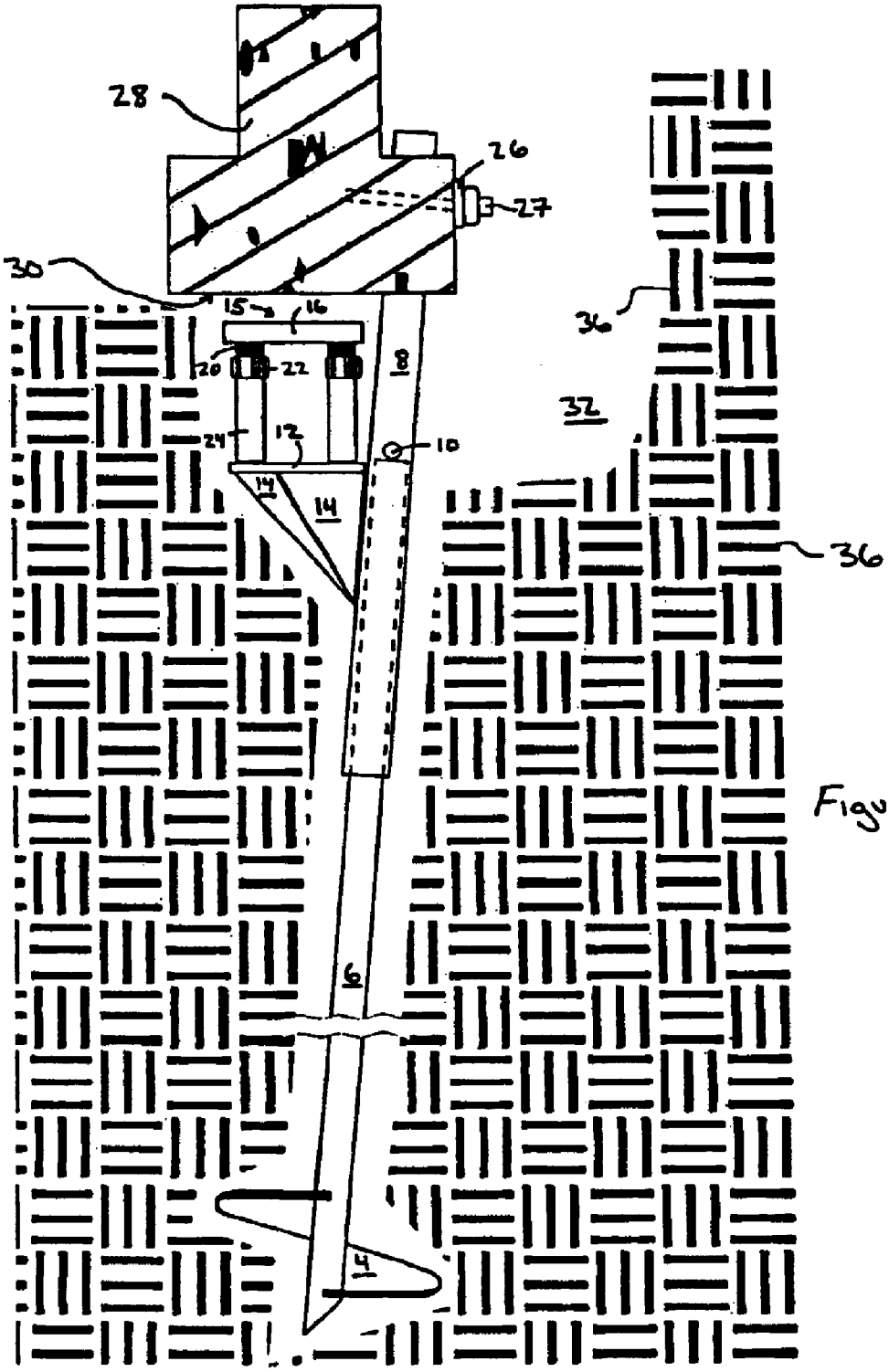
FIG. 6 depicts a preferred present embodiment of the invention in a preferred manner of installation where a jack screw is placed on a pier cap stabilizer.

FIG. 6 depicts a preferred present embodiment of the invention in a preferred manner of installation where a jack screw 15 is placed on a pier cap stabilizer 8. At this stage of installation, clamp 26 is fastened to footer 28 with one or more bolts 27. Clamp 26 functions to secure the top of pier cap stabilizer 8 to footer 28. Jack screw 15 is positioned such that jack platform 16 is at the top and threaded shafts 20 extend toward the bottom. The threaded shafts 20 rest upon shelf 12. Note that pier cap stabilizer 8 is driven down on pier shaft 6 such that bolt 10 rests upon the top surface of pier shaft 6.

Pier cap stabilizer 8 serves a variety of functions. First, it supports shelf 12 that is the resting platform for screw jack 15. Through having pier cap stabilizer 8 separate from pier shaft 6, the installation process is greatly simplified. Having pier cap stabilizer 8 enables pier shaft 6 to be installed without having a complex bracket assembly mounted to footer 28. Further, through having pier cap stabilizer 8 separate ensures that pier cap stabilizer 8 is not damaged while the pier shaft 6 is driven into the earth 36.

In addition, note in FIG. 6 that the pier shaft 6 overlaps pier cap stabilizer 8 for a region where gussets 14 mount to pier cap stabilizer 8. The position where gussets 14 are mounted to pier cap stabilizer 8 is a potential device failure point due to buckling. However, in the design of the present invention, the side-wall thickness of pier shaft 6 combines with the side-wall thickness of pier cap stabilizer 8 to reduce the possibility of buckling.

Figure 7:
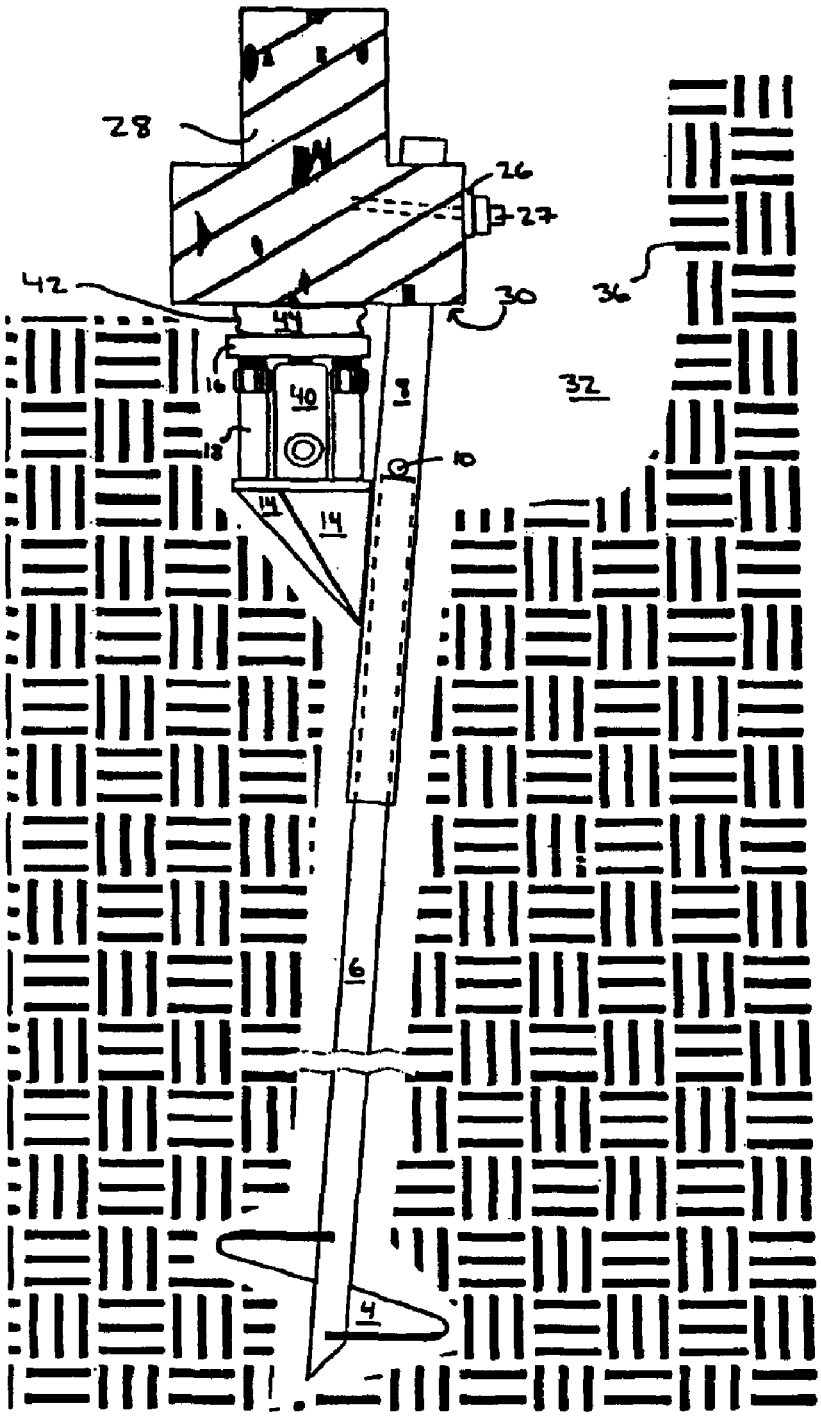
FIG. 7 depicts a preferred present embodiment of the invention in a preferred manner of installation where a hydraulic ram is placed under a jack screw in order to lift a footing of a structure vertically.
Figure 8:
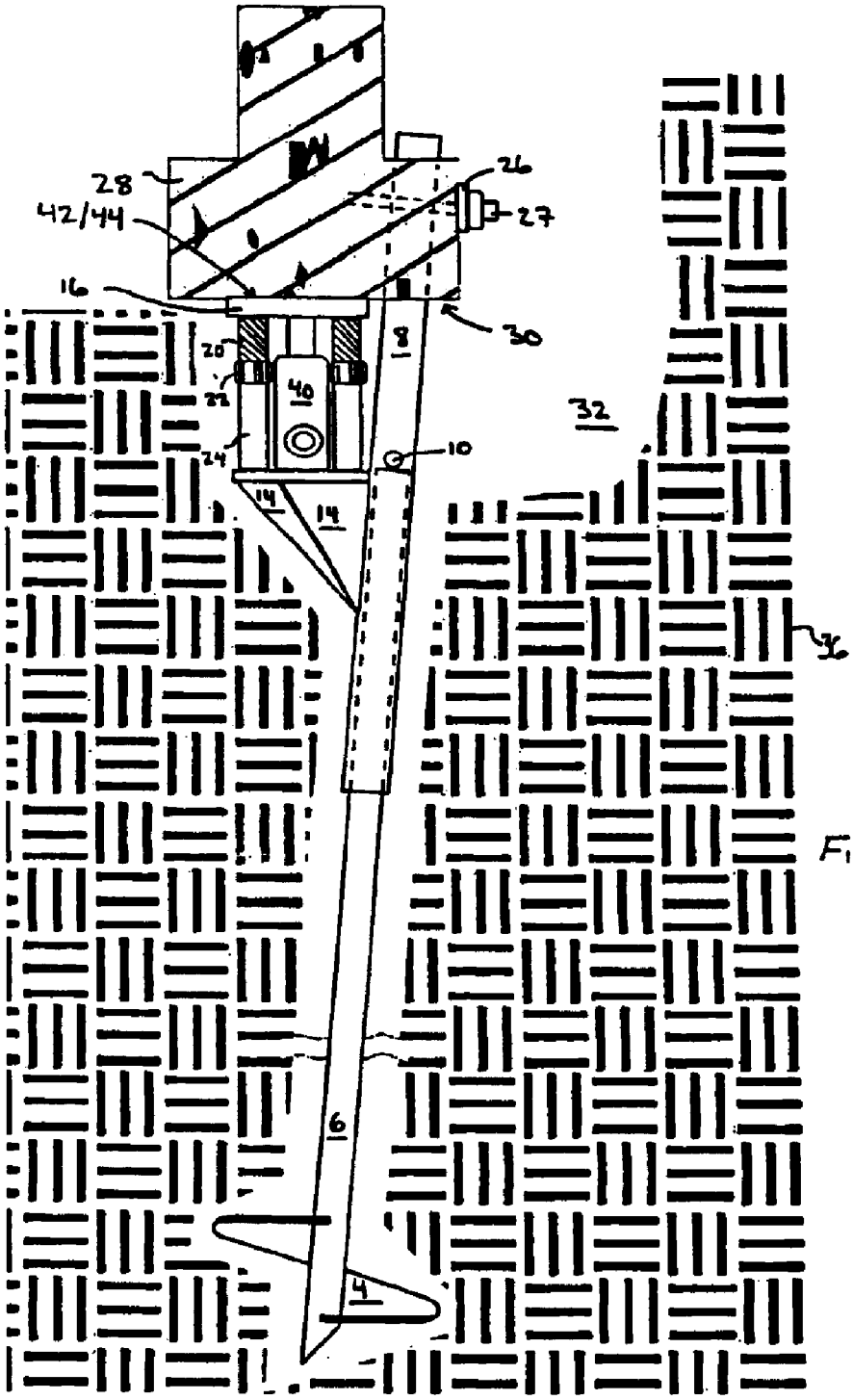
FIG. 8 depicts a preferred present embodiment of the invention in a preferred manner of installation where a hydraulic ram has completed lifting a footing of a structure vertically.

FIG. 7 depicts a preferred present embodiment of the invention a preferred manner of installation where a hydraulic ram 40 is placed under a jack screw 15 in order to lift footing 28 of the structure vertically. Settling and subsidence can lower the level of the footing 28 with respect to earth 36. Further, this settling can occur in an uneven manner causing parts of footing 28 to settle more than others. Piers 2 can remedy this problem by using hydraulic rams 40. Hydraulic rams 40 are placed on top of shelf 12 under jack platform 16. Hydraulic ram 40 pushes platform 16 up against bottom surface 30 of footing 28.

When platform 16 comes into contact with footing 28, hydraulic ram 40 pushes footing 28 upwards. The force of the house is transferred through shelf 12 and gussets 14 into the pier cap stabilizer 8, pier shaft 6, and finally helix 4.

Bottom surface 30, while shown flat, of building footer 28 is typically very rough. In order to create footer 28, construction workers typically dig a trench. Side-wall forms are placed along the sides of the trench to give the footer 28 its shape. The top surface of the footer 28 is smooth to receive the remainder of the building structure. However, the form that shapes the bottom surface 30 of the footer 28 is the bare ground. The concrete poured into the side-walls forming the footer 28 takes the shape of the ground's contours, the rocks, gravel, and dirt clods. Consequently, the bottom surface 30 of the footer 28 is typically very rough.

In order to attach helical pier 2 to bottom surface 30 of footer 28, it is necessary to prepare footer 28. To have a solid mechanical connection between the screw jack 15 and the bottom of footer 28, it is necessary to address the unevenness of bottom surface 30 of footer 28. Otherwise, if screw jack 15 is placed against uneven surface 30, stress fractures will occur in footing 28 damaging the structure and retarding the ability of helical pier 2 to support the building.

The present invention prepares footer 28 by inserting a flexible bag 42 filled with unhardened concrete 44 between the top surface of screw jack platform 16 and bottom surface 30 of footer 28. As jack screws 18 are turned until the required support contact is achieved between the pier cap stabilizer 8 and footing 28, bag 42 of unhardened concrete 44 is compressed between top plate 16 of screw jack 15 and bottom surface 30 of footer 28. Unhardened concrete 44 fills in the voids and contours on bottom surface 30 of footer 28 between footer 28 and top of the jack screw 16. When concrete 44 hardens, a flat surface is created between jack screw 15 and bottom 30 of footer 28. Consequently, this design reduces the presence of stress cracks at the position where footer 28 is supported by jack screw 15. Further, the use of bag 42 of unhardened concrete 44 is a very simple and cost effective means of preparing bottom surface 30 of footer 28. Consequently, the use of bag 42 greatly reduces the material and labor costs on installing helical pier 2.

Figure 9:
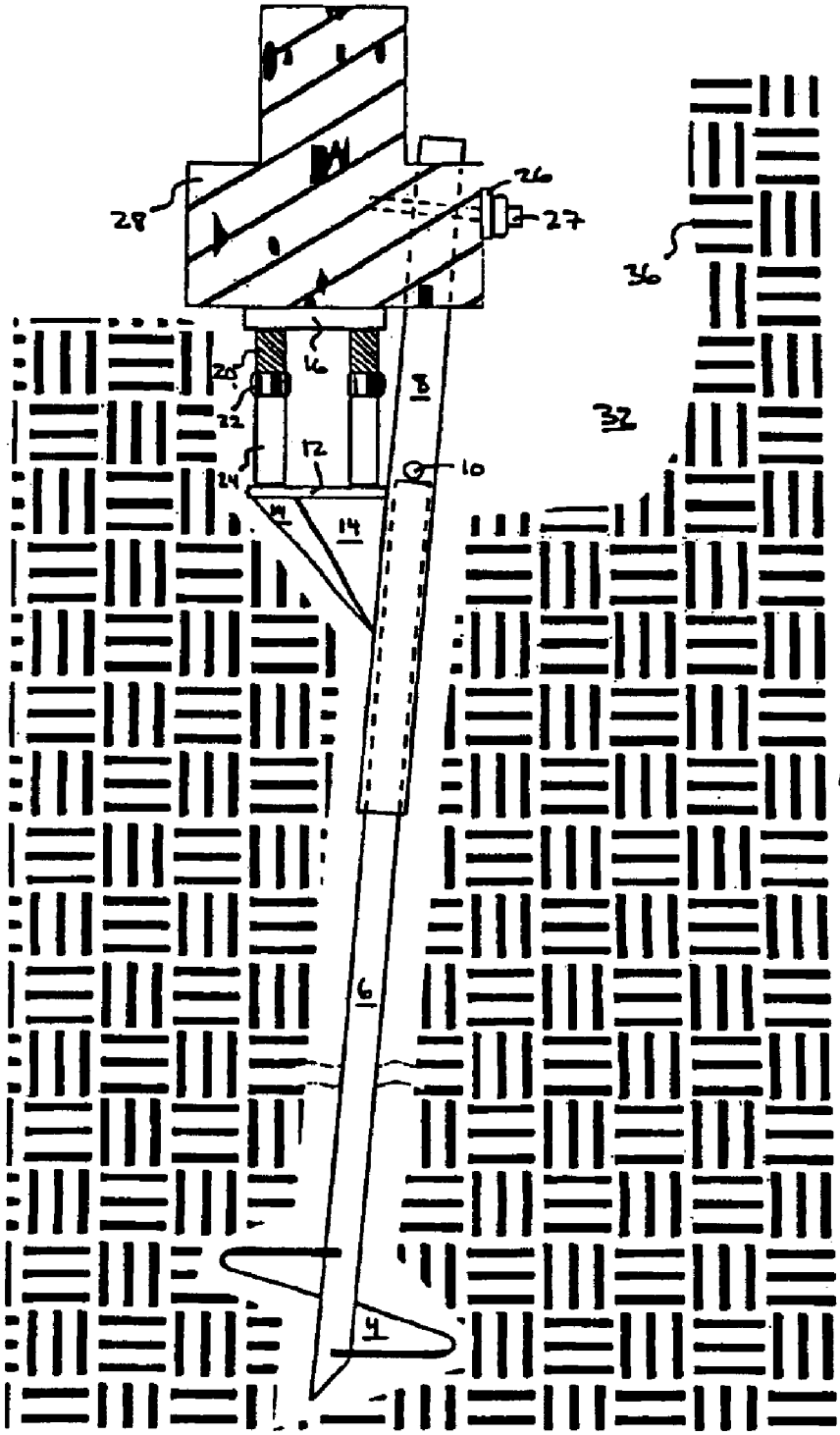
FIG. 9 depicts a preferred present embodiment of the invention in its final stage of installation.

FIG. 9 depicts a preferred present embodiment of the invention in its final stage of installation. In this figure, hydraulic ram 40 has completed lifting footer 28 to its final resting position. Note the changes in screw jack 15. Platform 16 is pressed firmly against bottom surface 30 of footer 28 with concrete 44 pressed firmly between. Jack sleeves 24 are rotated down until they firmly press against shelf 12. Note that now threaded shafts 20 are exposed. In this final stage of installation hydraulic ram 40 is removed from pier 2. Earth 36 is then filled in around the hole excavated to install pier 2. With the filling of earth 36, the installation of pier 2 is complete.

Figure 10:
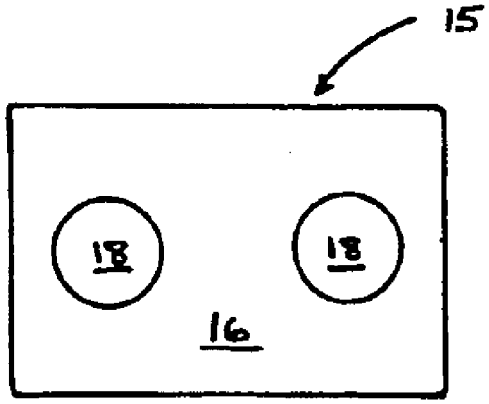
FIG. 10 depicts a preferred screw jack configuration of a preferred present embodiment of the invention.

FIG. 10 depicts a preferred screw jack configuration of a preferred present embodiment of the invention. In a preferred embodiment, two jack screws 18, formed of a threaded shaft 20, nut 22, and jack sleeve 24 are used for jack screw 15.

Figure 11:
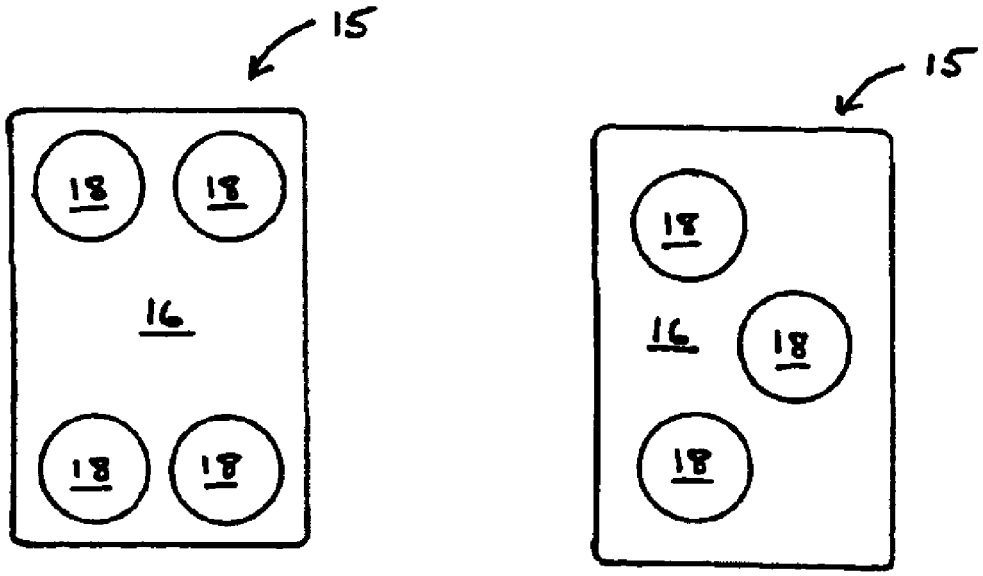
FIG. 11 depicts an alternative screw jack configuration of a preferred present embodiment of the invention.

FIG. 11 depicts two alternative screw jack configurations of a preferred present embodiment of the invention. In alternative embodiment, configurations of three or four jack screws 18 are used to form jack screw 15.

Detailed Description of an Alternative Embodiment

Figure 12:
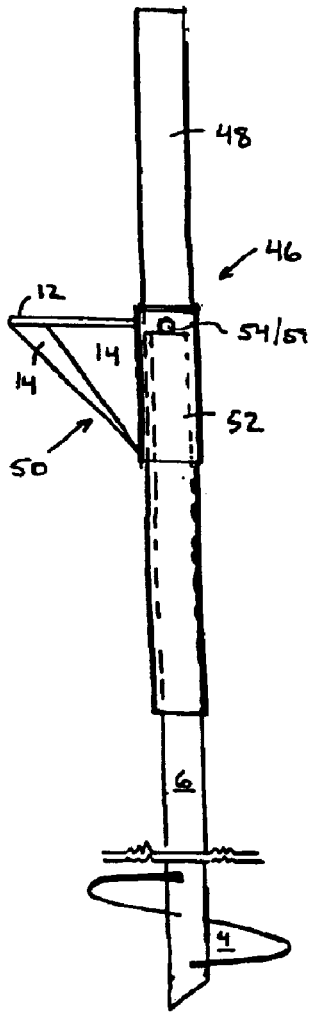
FIG. 12 depicts an alternative embodiment of the present invention.

FIG. 12 depicts an alternative embodiment of the present invention. The preferred embodiment of the invention has a single piece pier cap stabilizer 8. The alternative embodiment has a two piece pier cap stabilizer assembly 46. Two piece pier cap stabilizer assembly 46 is comprised of a vertical stabilizer 48 and a shelf structure 50. Shelf structure 50 is comprised of a shelf 12, a tube 52, and three gussets 14. Tube 52 has a hole 54 drilled through it to allow the insertion of bolt 56. Vertical stabilizer 48 has a hole 58 drilled through it to also allow the insertion of bolt 56.

Figure 13:
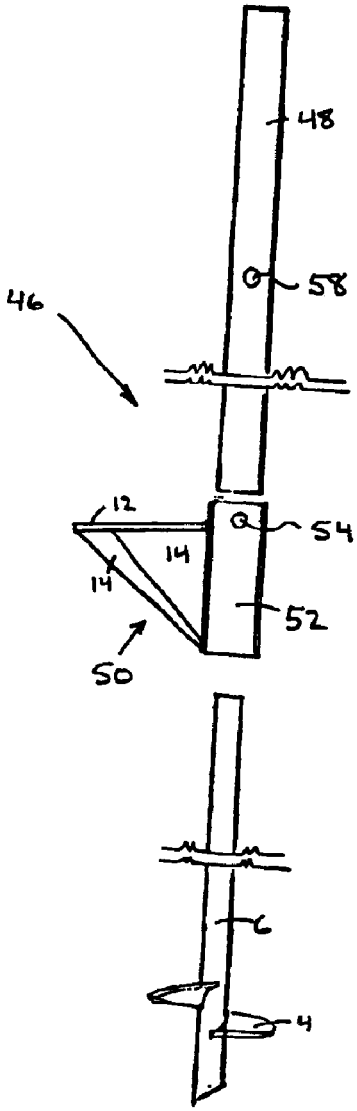
FIG. 13 depicts a disassembled view of an alternative embodiment of the present invention.

FIG. 13 depicts a disassembled view of an alternative embodiment of the present invention. In this figure are the three basic components of the alternative embodiment of the present invention. The three components are the vertical stabilizer 48, the shelf structure 50, and the pier shaft 6 and helix 4.

Figure 14:
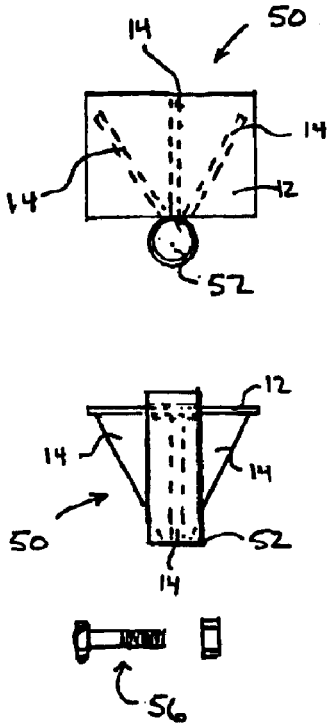
FIG. 14 depicts side and top views of shelf structure of an alternative embodiment of the invention.

FIG. 14 depicts side and top views of shelf structure 50 having shelf 12, tube 52, and three gussets 14. Tube 52 has hole 54 drilled through it to allow the insertion of bolt 56.

Figure 15:
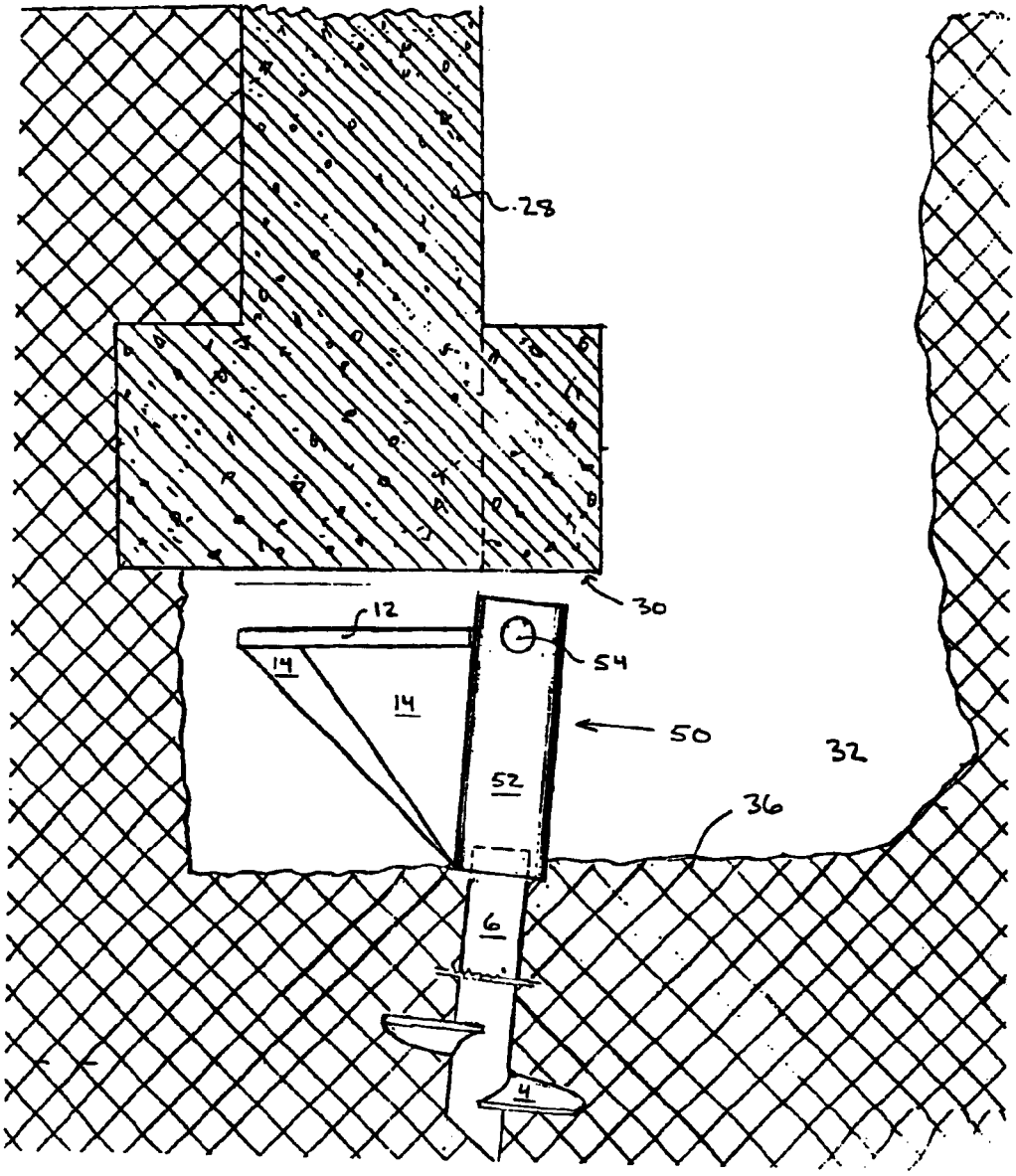
FIG. 15 depicts an alternative embodiment of the present invention at a stage of installation where a shelf structure is installed on a helical pier.

FIG. 15 depicts an alternative embodiment of the present invention at a stage of installation where shelf structure 50 is installed on pier shaft 6. At this stage of installation, pier shaft 6 and helix 4 have been driven to a depth where pier shaft 6 reaches bedrock or until the pier's frictional resistance equals the compression weight of the structure. Pier shaft 6 is then cut off at the top just below footer 28. Separating shelf structure 50 from cap stabilizer assembly 46 eliminates the need to rotate shelf 12 into position under footer 28 as is required by a preferred embodiment of the present invention.

Figure 16:
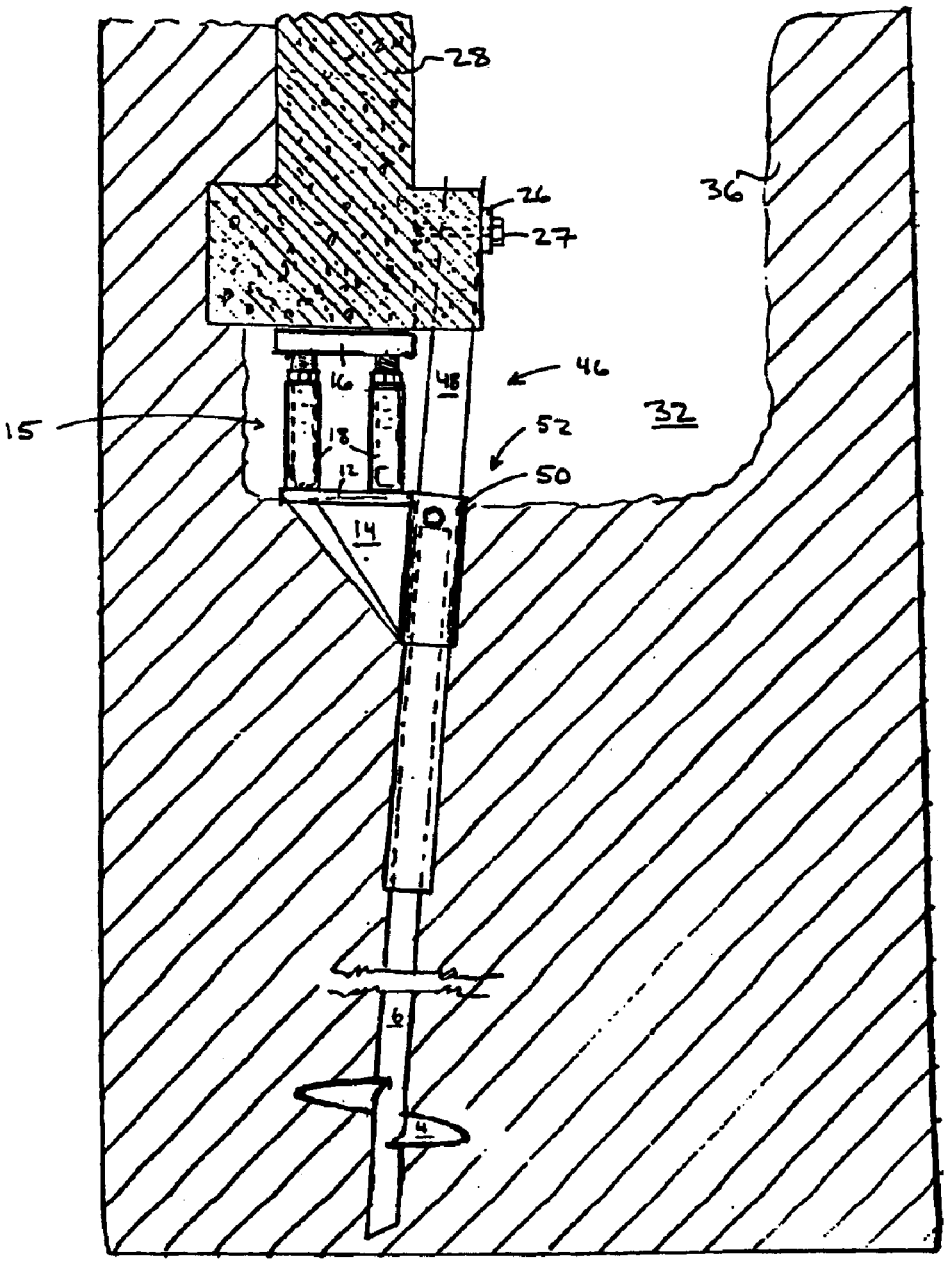
FIG. 16 depicts an alternative embodiment of the present invention at a final stage of installation.

FIG. 16 depicts an alternative embodiment of the present invention at a final stage of installation. The process for going from FIG. 15 to the final stage of installation requires that vertical stabilizer 48 be driven through tube 52 down over pier shaft 6 in order for holes 54 and 58 to align just above the top of pier shaft 6. Bolt 56 is then inserted through holes 54 and 58 and is then secured. From this stage on, the remaining installation processes for installing this alternative embodiment are identical to the processes required to install a preferred embodiment described above.

Detailed Description of an Alternative Embodiment Utilizing a Straight Pier

Figure 17:
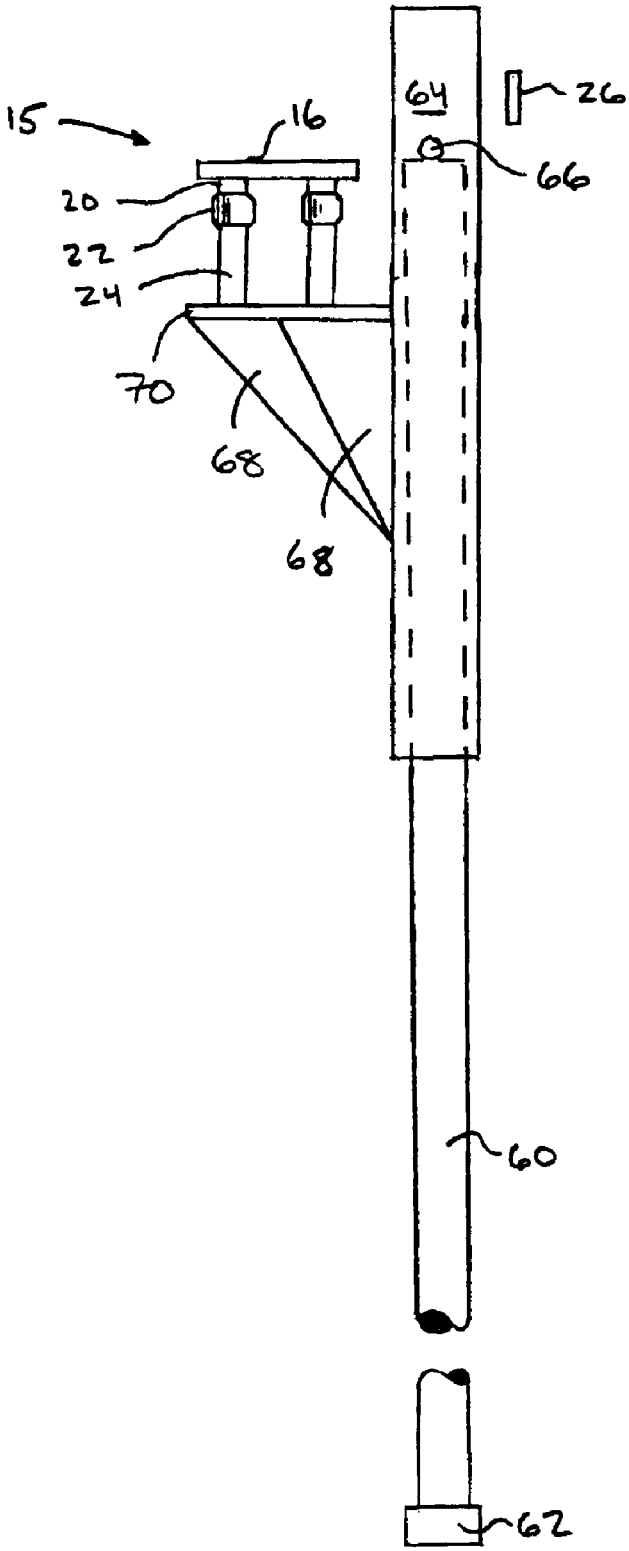
FIGS. 17–24 depict a further alterative embodiment of the invention utilizing a straight pier.

FIGS. 17–24 depict a further alterative embodiment of the invention utilizing a straight pier. Referring to FIG. 17, FIG. 17 illustrates a side view of a straight pier 60 having a pier cap stabilizer 64 and screw jack assembly 15. Straight pier 60 is a cylindrical steel pier that supports the weight of a building. Where as helical pier 2 is driven down to a level in the earth where the pier's 2 frictional resistance is equal to or greater than the compression weight of the structure, straight pier 60 is driven down into a layer of bedrock 88, or other solid layer of earth. Straight pier 60 is referred to as a straight pier due to the fact that it is driven into earth 36 vertically with respect to the building, in contrast to helical pier 2 that is driven in at an angle with respect to the building.

Straight pier 60 includes a pier cap 62. Pier cap 62 is a steel ring welded to the end of pier 60. When driving straight pier 60 through earth 36, earth 36 places a frictional resistance along the shaft forming straight pier 60. This frictional resistance retards the ability of a hydraulic ram to push straight pier 60 down to a layer of bedrock 88. Pier cap 62 is provided to reduce this frictional force on straight pier 60. As straight pier 60 is driven through earth 36, pier cap 62 makes a shaft hole larger than straight pier 60, thereby keeping earth 36 from causing as much friction on straight pier 60.

A pier cap stabilizer 64 is coupled to straight pier 60 to enable straight pier 60 to support the weight of a building by supporting a footing or foundation without the use of a bracket. Pier cap stabilizer 64 includes a pin 66 that extends through pier cap stabilizer 64. Pin 66 rests against the top of straight pier 60, thereby preventing pier cap stabilizer 64 from sliding down along straight pier 60. Since straight pier 60 is mounted to a footing or foundation vertically, shelf 70 is mounted at a right angle with respect to straight pier 60 with gussets 68.

A screw jack assembly 15 rests upon shelf 70. Screw jack assembly includes a screw jack platform 16 that is supported by two or more screw jacks formed by threaded shafts 20, nuts 22, and jack sleeves 24. Nuts 22 are welded to jack sleeves 24, such that threaded shafts 20 threadably engage nuts 22. With screw jacks formed by 20, 22, and 24, screw jack platform 16 is raisable with respect to shelf 70. Straight pier 60 is positioned within notch 34 formed in footer 28.

Figure 18:
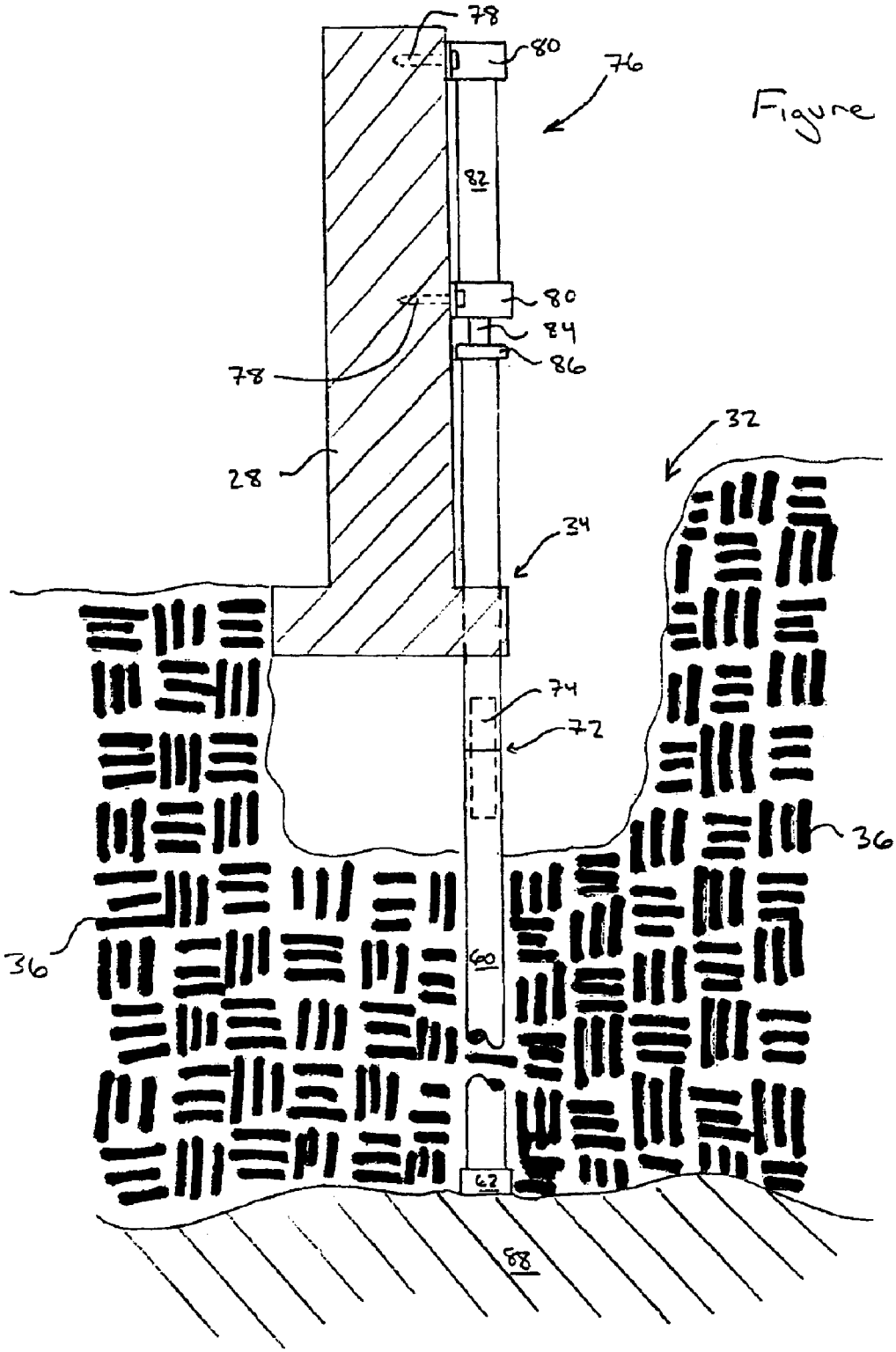

FIG. 18 illustrates an installation of straight pier 60 with footing 20 utilizing a hydraulic ram 76. In order to drive straight pier 60 down to a depth where it encounters bedrock 88, straight pier 60 may be formed from several lengths of steel shafts that are joined at joints 72. In order to provide strength to joints 72, a smaller internal steel shaft 74 is placed within joint 72. Straight pier 60 is driven through earth 36 vertically with respect to footing 28 through the use of hydraulic ram 76. Hydraulic ram 76 is bolted to footing 28 with bolts 78. Bolts 78 secure steel brackets 80 to footing 28. A hydraulic piston 82 is held in position by steel brackets 80. Hydraulic piston 82 places force against straight pier 60 with the use of piston rod 84 and piston rod cap 86. Forcing hydraulic fluid into hydraulic piston 82 causes piston rod 84 to drive straight pier 60 into earth 36. Once hydraulic piston 82 is fully extended, piston 82 is retracted so that a new pier shaft 60 can be mated with a joint 72 and internal shaft 74 in order to continue the installation process and lengthen pier shaft 60.

Straight pier 60 is driven into earth 36 until pier cap 62 contacts a layer of bedrock 88. The use of pier cap 62 reduces the amount of friction caused by earth 36 against straight pier 60. Note that a hole 32 is excavated around footing 28 in earth 36 in order to facilitate installation of straight pier 60.

Figure 19:
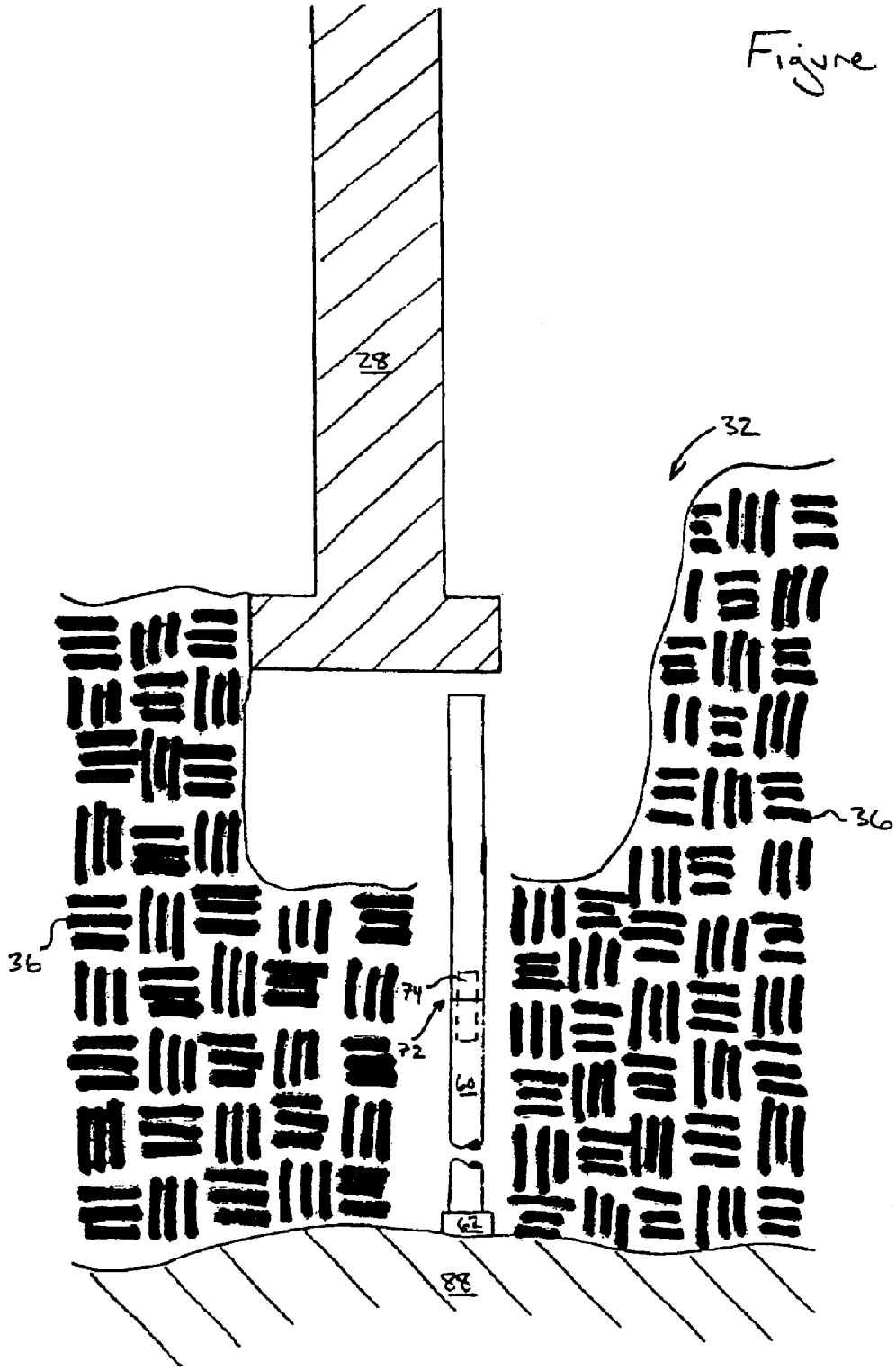

FIG. 19 illustrates an installation of a straight pier with a footing. At this stage of installation, straight pier 60 has reached a layer of bedrock 88 upon which it can support the weight of the building through footer 28. Hydraulic ram 76 is removed from footer 28.

Figure 20:
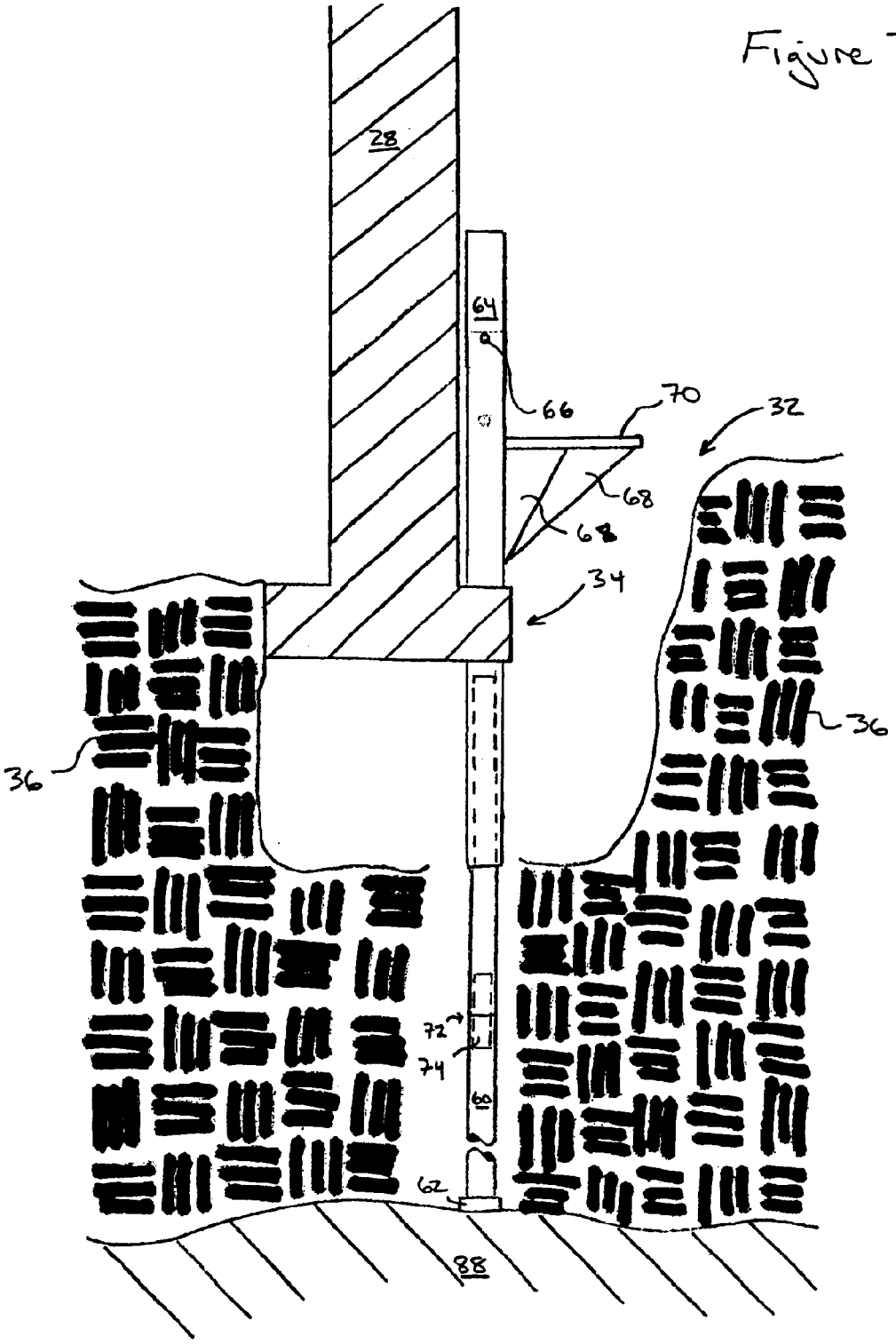

FIG. 20 illustrates an installation of pier cap stabilizer 64 on straight pier 60. Pier cap stabilizer 64 is positioned over straight pier 60 such that shelf 70 and gussets 68 extend away from footer 28. Pier cap stabilizer 64 is then driven down over straight pier 60 until shelf 70 is below the base of footer 28.

Figure 21:
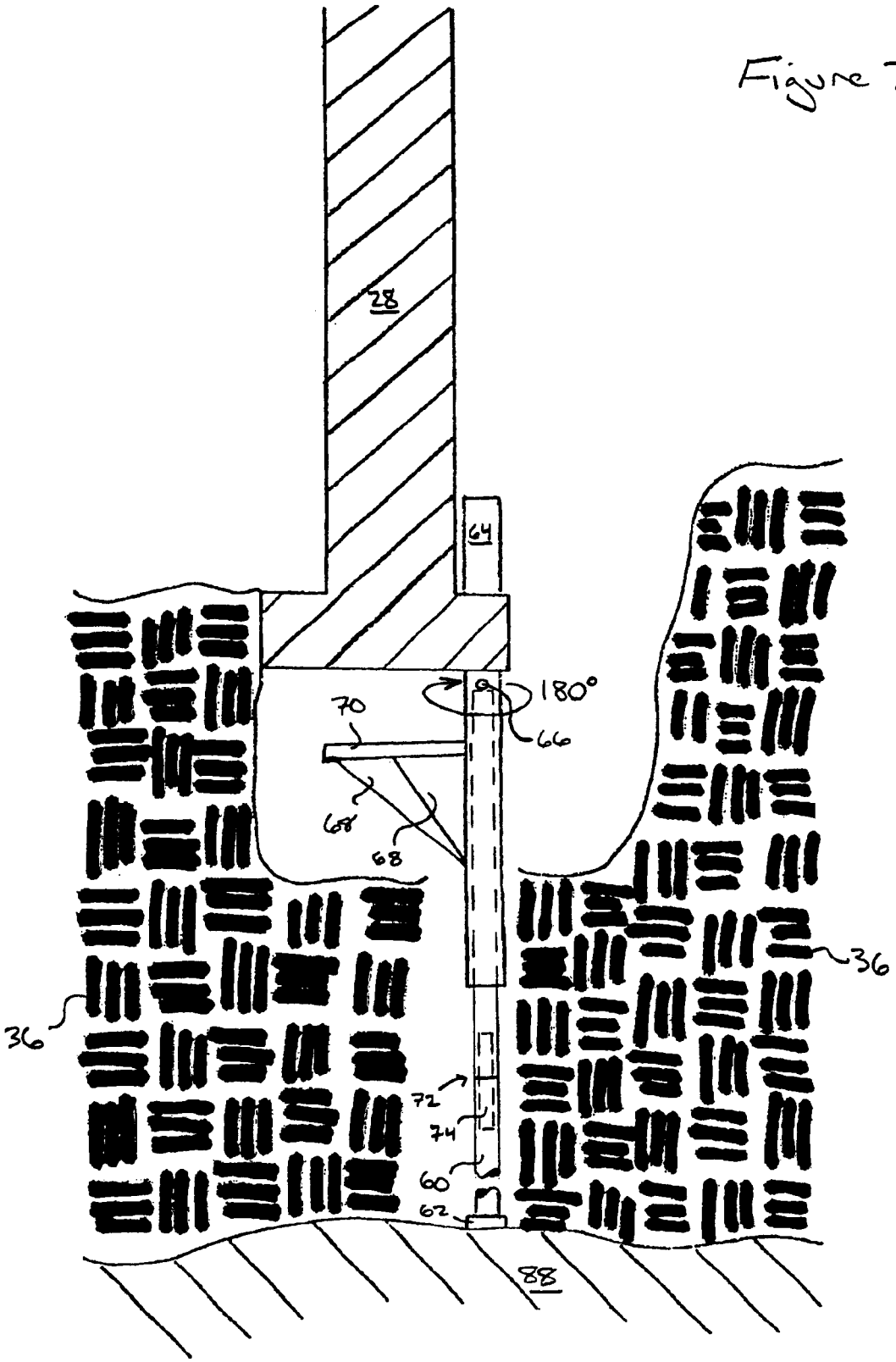

FIG. 21 illustrates an installation of pier cap stabilizer 64 on straight pier 60. Once pier cap stabilizer 64 is driven to a level where shelf 70 is below the bottom surface of footer 28, pier cap stabilizer 64 is rotated 180 degrees such that shelf 70 supported by gussets 68 extends directly under footer 28. Pier cap stabilizer 64 is driven down onto straight pier 60 until the top surface of straight pier 60 contacts pin 66. Pin 66 prevents pier cap stabilizer 64 from sliding further down over straight pier 60.

Figure 22:
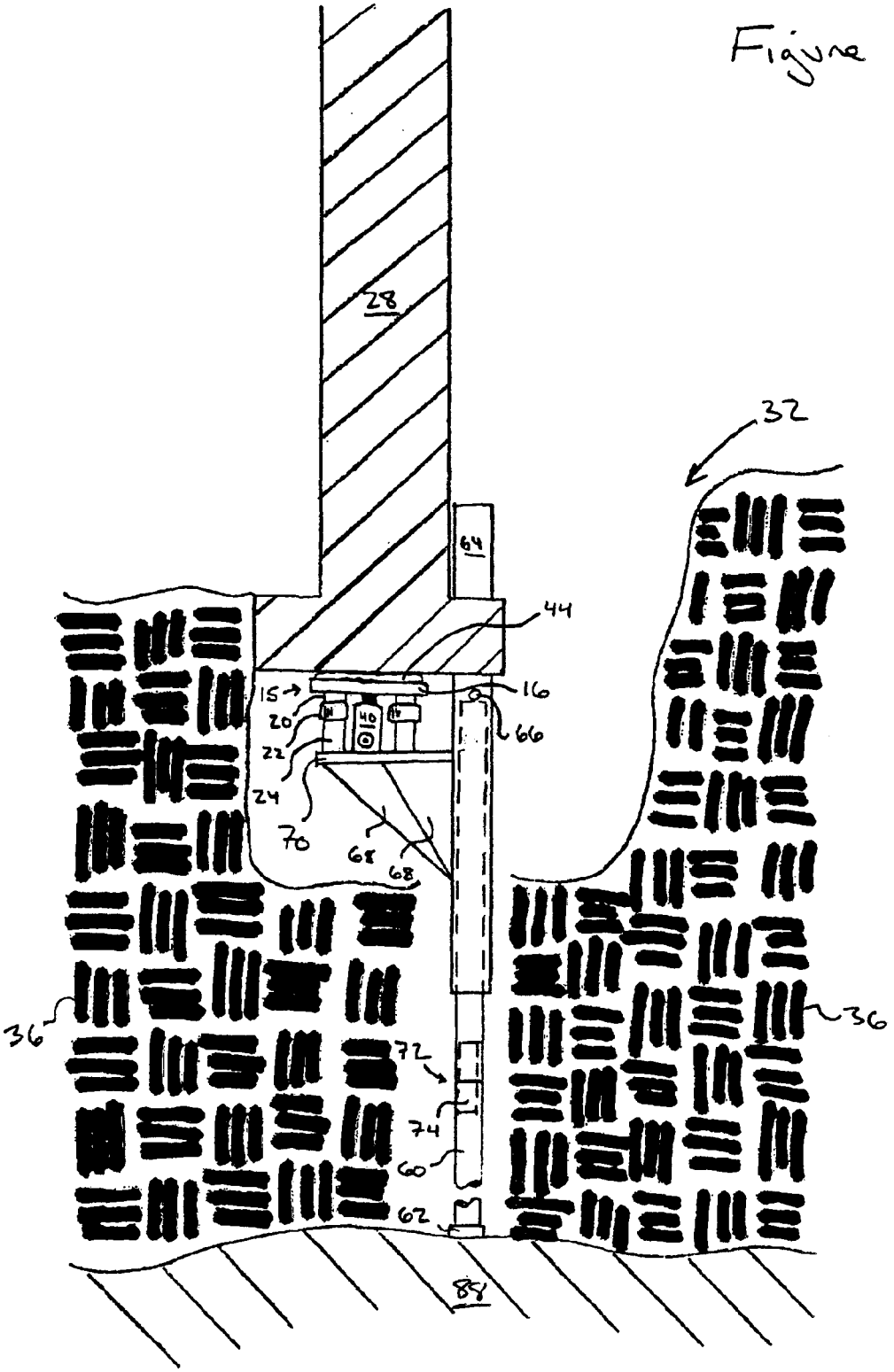

FIG. 22 illustrates an installation of screw jack assembly 15 on pier cap stabilizer 64 and straight pier 60 where hydraulic ram 40 lifts footing 28 with respect to pier cap stabilizer 64. Screw jack assembly 15 is positioned on shelf 70. A bag 44 of cement or other construction material is placed on top of screw jack platform 16 in order to compensate for the uneven surface on the bottom of footer 28. Hydraulic ram 40 presses jack platform 16 against the base of footer 28. Then hydraulic ram 40 pushes footer 28 upwards against shelf 70, thereby raising the building. The building is raised by hydraulic ram 40 until such time as the settling of the building is compensated fully. Nuts 22 welded to jack sleeves 24 are then rotated to put jack sleeves in contact against shelf 70. With jack sleeves extended against shelf 70, screw jack 15 can support the weight of footer 28 without the presence of ram 40.

Figure 23:
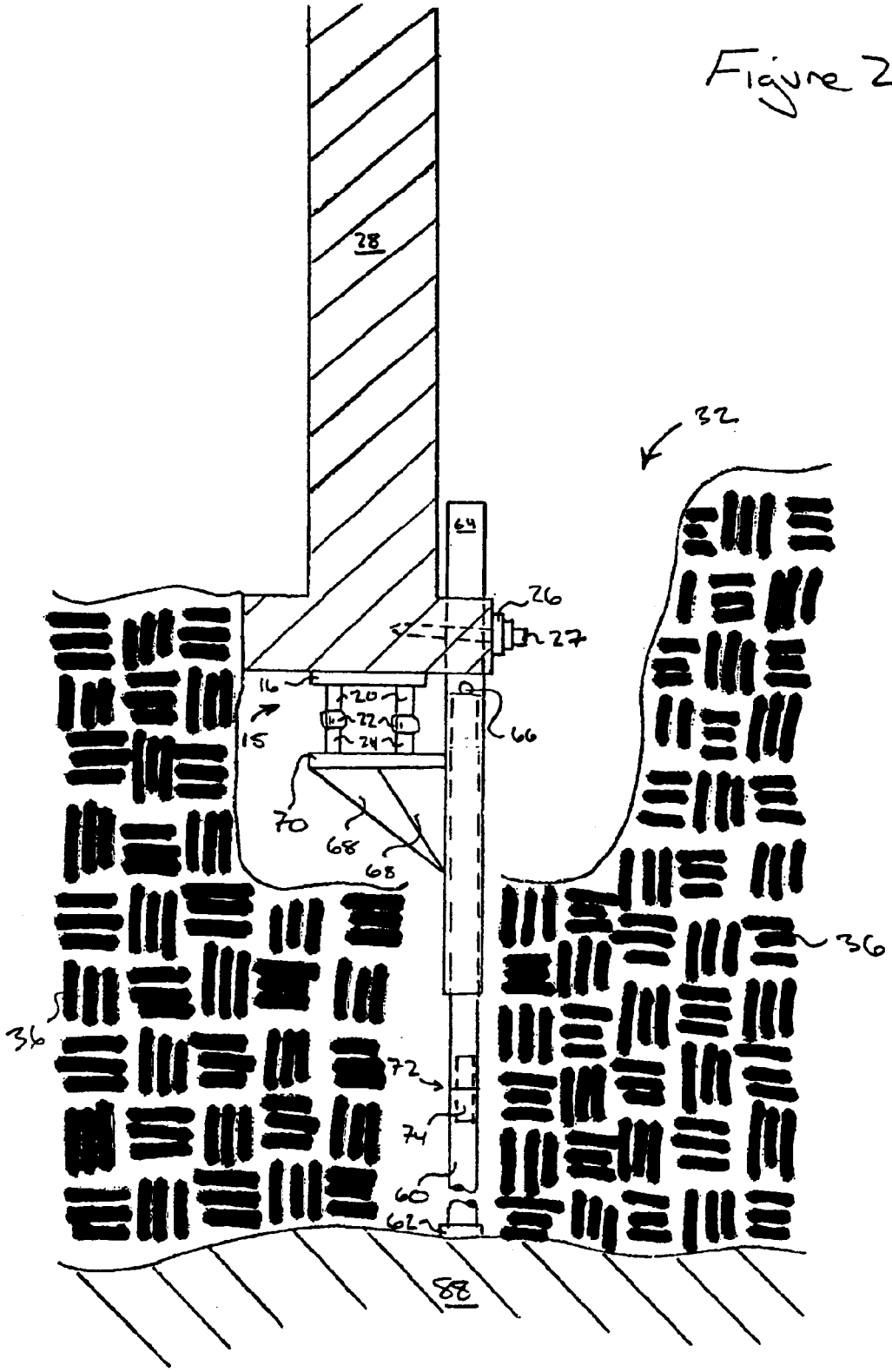

FIG. 23 illustrates an installation of screw jack assembly 15 on pier cap stabilizer 64 and straight pier 60. In this stage of installation, hydraulic ram 40 is removed, thereby leaving footer 28 resting on jack assembly 15. The weight of the building is then transferred to bedrock 88 through jack assembly 15, pier cap stabilizer 64, and straight pier 60. A pin or bolt 27 extends through plate 26 in order to bolt a top portion of straight pier 64 to footer 28, thereby providing additional structural stability.

Figure 24:
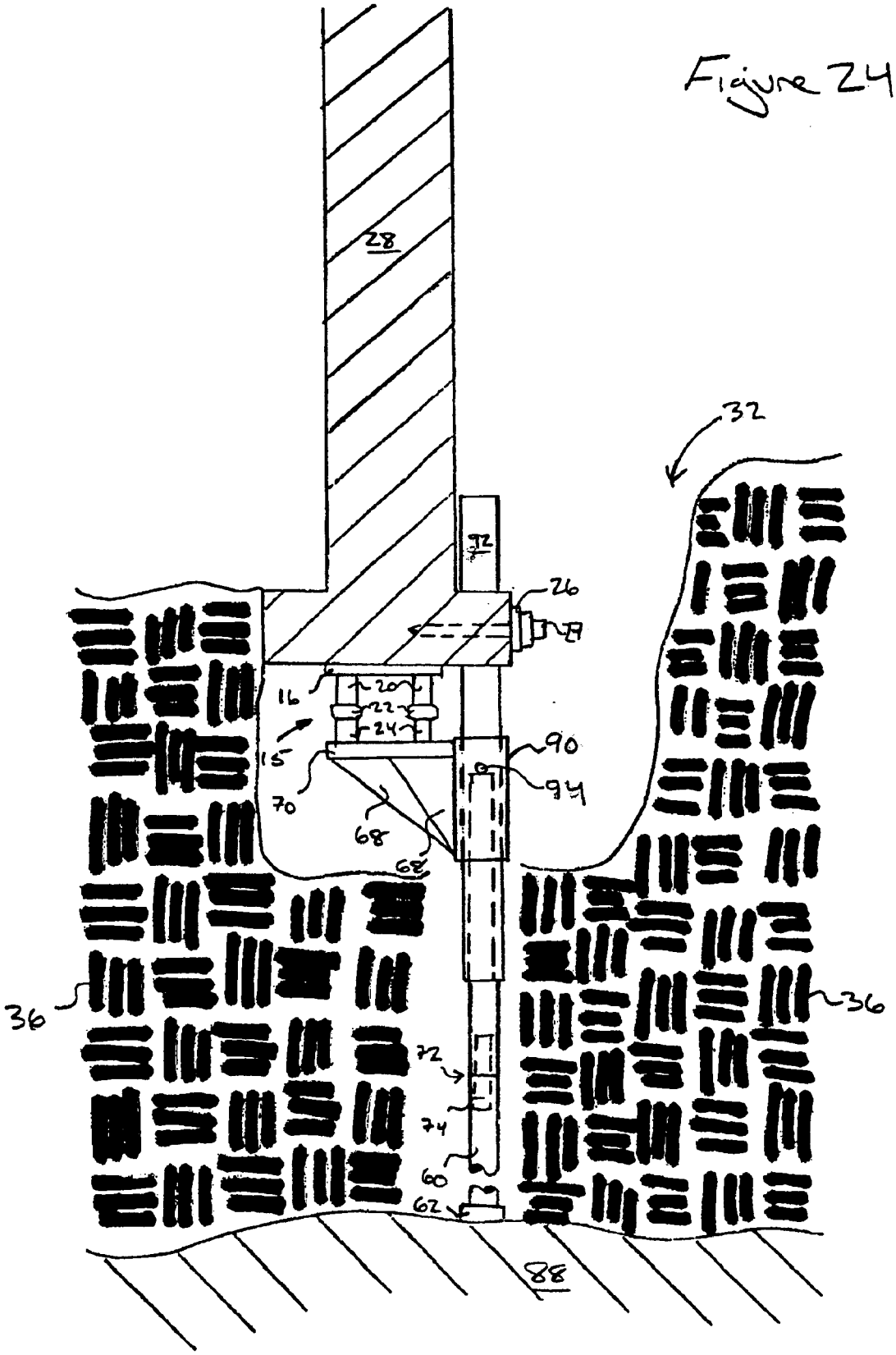

FIG. 24 illustrates an additional alternative embodiment utilizing straight pier 60 where a pier cap stabilizer 76 is formed from two components. This alternative embodiment utilizing straight pier 60 is analogous to the alternative embodiment of pier cap stabilizer 46 illustrated in FIGS. 12–16 for helical pier 2. As with pier cap stabilizer 46, pier cap stabilizer 72 is formed from two components. A shelf 70 and gussets 68 are mounted to a tube 90. Tube 90 slides over vertical stabilizer 92. A pin or bolt 94 extends through tube 90 and vertical stabilizer 92, also referred to as shaft 92, in order to secure tube 90 to vertical stabilizer 92, thereby forming the pier cap stabilizer. Pin 94 rests against the top surface of straight pier 60, thereby holding the pier cap stabilizer in a fixed vertical position with respect to straight pier 60.

Figure 25:
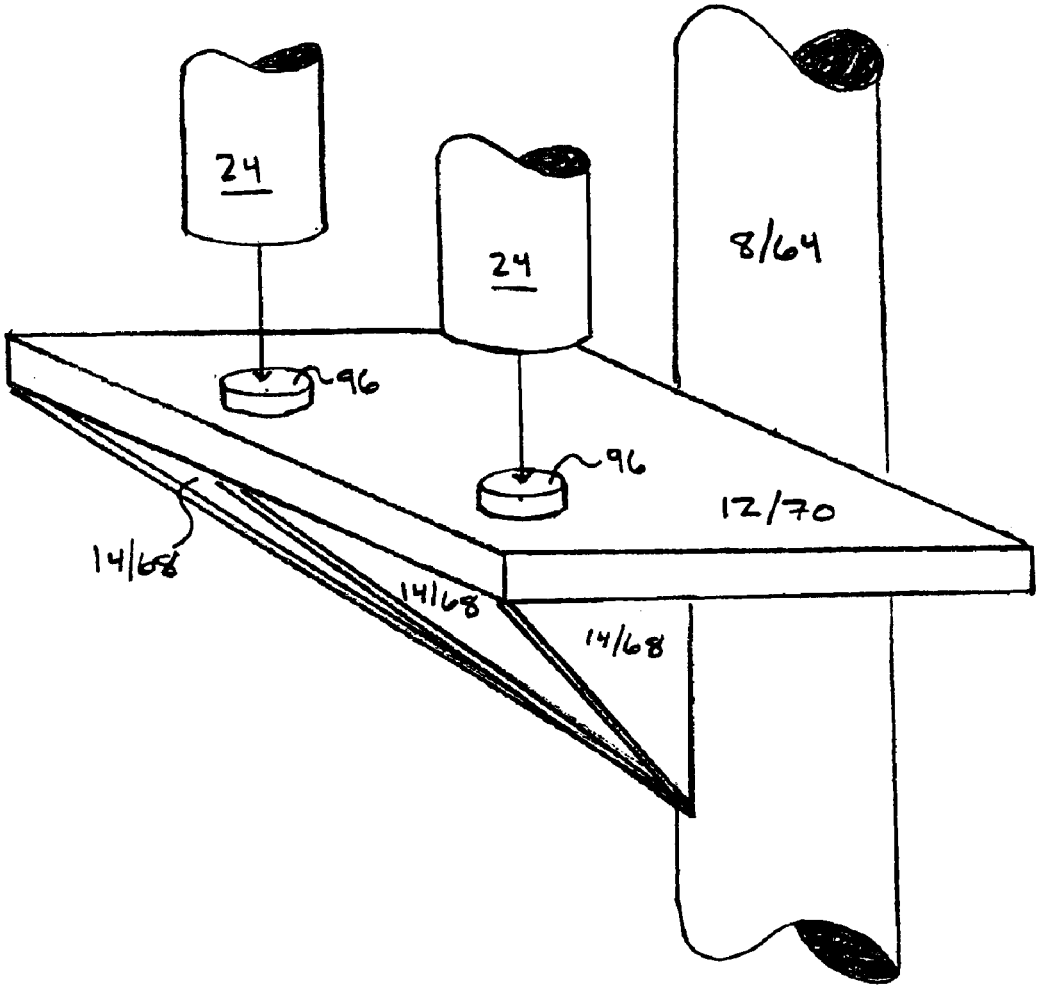
FIG. 25 illustrates a pier cap stabilizer shelf having screw jack guides.

FIG. 25 illustrates a pier cap stabilizer shelf 12/70 having screw jack guides 96. Jack sleeves 24 are hollow tubes. Screw jack guides 96 are rods that are attached to pier cap stabilizer shelf 12/70. Screw jack guides 96 have a diameter slightly smaller than the inner diameter of jack sleeves 24 so that jack sleeves 24 fit over screw jack guides 96. Screw jack guides are provided to provide a precise location for positioning jack sleeves 24 on shelf 12/70 and to ensure that jack sleeves 24 do not move when screw jack assembly 15 is placed on shelf 12/70. While two screw jack guides 96 are shown as an example, other numbers and configurations of screw jack guides 96 on shelf 12/70 are possible.

Although the present invention has been described in detail, it will be apparent to those of skill in the art that the invention may be embodied in a variety of specific forms and that various changes, substitutions, and alterations can be made without departing from the spirit and scope of the invention. The described embodiments are only illustrative and not restrictive and the scope of the invention is, therefore, indicated by the following claims.

What is claimed is:

1. A pier assembly for supporting a structure, comprising:

a pier driven into an earth in proximity with a footer supporting said structure;

a pier cap stabilizer shaft mounted to a top end of said pier, wherein a top portion of said pier cap stabilizer shaft extends above a bottom surface of said footer, wherein the top portion of said pier cap stabilizer shaft is mounted to said footer;

a shelf mounted to said pier cap stabilizer shaft; and a screw jack positioned on a top surface of said shelf that adjustably extends between said shelf and the bottom surface of said footer.

2. The pier of claim 1, wherein said pier includes a helix mounted to a bottom end of said pier.

3. The pier of claim 1, further comprising a flexible bag containing structural material, said flexible bag positioned on a top surface of said screw jack under the bottom surface of said footer.

4. The pier of claim 1, wherein said pier cap stabilizer shaft is comprised of:

a shaft that extends over said pier;

a tube that slides over said shaft;

said shelf mounted to the side of said tube; and a pin that extends through said shaft and said tube, thereby locking said shaft to said tube.

5. The pier of claim 1, further comprising a plate that secures the top portion of said pier cap stabilizer shaft to said footer.

6. The pier of claim 1, further comprising a pin that extends through said pier cap stabilizer shaft, said pin rests against a top surface of said pier.

7. The pier of claim 1, wherein a pier cap is mounted to a bottom end of said pier.

8. The pier of claim 1, further comprising a screw jack guide on said shelf to locate the placement of said screw jack on said shelf.

9. A pier assembly for supporting a notched footer of a building, comprising:

a pier extending through the notch formed in said footer down to a weight bearing layer of earth;

a rotatable shelf mounted to said pier, wherein said shelf extends away from said footer when said shelf is positioned on said pier and is rotated into position under a bottom surface of said footer;

a screw jack assembly positioned on said shelf and adjustably extending up to the bottom surface of said footer; and a pin securing a top portion of said pier to said footer above the bottom surface of said footer.

10. The pier assembly of claim 9, wherein said pier is positioned vertically with respect to said footer.

11. The pier assembly of claim 10, wherein said pier further comprising a pier cap mounted to a bottom end of said pier.

12. The pier assembly of claim 9, wherein said pier further comprising a helix mounted to a bottom end of said pier.

13. The pier assembly of claim 9, wherein said shelf is mounted to a tube that extends over said pier.

14. The pier assembly of claim 13, further comprising a pin that extends through said tube securing said tube to said pier.

15. The pier assembly of claim 14, further comprising a shaft that extends over said pier, said tube extends over said shaft, wherein a pin extends through said tube and said shaft, thereby securing said tube to said shaft.

16. The pier assembly of claim 9, further comprising a screw jack guide on said shelf to locate the placement of said screw jack on said shelf.

* * * * *